US005911267A

United States Patent [19]

Witte et al.

[11] Patent Number: 5,911,267

[45] Date of Patent: Jun. 15, 1999

[54] COPE WITH BORE FOR GASSING CORES

[75] Inventors: Raymond F. Witte, Naperville; Pheroze J. Nagarwalla, St. Charles, both of Ill.; Scott S. Hendrie, Coldwater, Mich.; Paul M. Korzenecki, Naperville, Ill.

[73] Assignee: Georg Fischer Disa, Inc., Oswego, Ill.

[21] Appl. No.: 08/747,876

[22] Filed: Nov. 13, 1996

[51] Int. Cl.[6] ..... B22C 9/10; B22C 7/06; B22C 9/12

[52] U.S. Cl. ..... 164/12; 164/16; 164/228

[58] Field of Search ..... 164/228, 16, 20, 164/200, 12

[56] References Cited

U.S. PATENT DOCUMENTS

| | | | |
|---|---|---|---|
| 2,659,119 | 11/1953 | Peterson | 22/13 |
| 2,807,064 | 9/1957 | Jay | 22/13 |
| 2,911,691 | 11/1959 | Peterson | 22/10 |
| 3,874,440 | 4/1975 | Voisin | 164/306 |
| 4,079,776 | 3/1978 | Niedermeyer | 164/154 |
| 4,217,949 | 8/1980 | Wustrow | 164/370 |
| 4,531,565 | 7/1985 | Uzaki et al. | 164/160.1 |
| 4,832,107 | 5/1989 | Hass et al. | 164/98 |
| 4,836,269 | 6/1989 | Bellis et al. | 164/200 |
| 4,844,141 | 7/1989 | Trumbauer et al. | 164/228 |
| 4,927,688 | 5/1990 | Hass et al. | 428/34.6 |
| 5,038,845 | 8/1991 | Kluge | 164/22 |
| 5,076,341 | 12/1991 | Noguchi | 164/120 |
| 5,148,851 | 9/1992 | Murata | 164/20 |
| 5,178,202 | 1/1993 | Dannoura et al. | 164/112 |
| 5,355,929 | 10/1994 | Sorenseu | 164/20 |
| 5,518,059 | 5/1996 | Blachowski | 164/16 |
| 5,520,240 | 5/1996 | Peterle | 164/183 |

FOREIGN PATENT DOCUMENTS

| | | | |
|---|---|---|---|
| 0 259 557 A1 | 3/1988 | European Pat. Off. | B22C 15/24 |
| 234381 | 5/1911 | Germany . | |
| 396813 | 6/1924 | Germany . | |
| 285837 | 11/1970 | Germany . | |
| 57-159234 | 10/1982 | Japan | 164/16 |
| 59-166349 | 9/1984 | Japan | B22C 9/12 |
| 63-224840 | 9/1988 | Japan | 164/16 |
| 1197768 | 12/1985 | U.S.S.R. | B22C 9/10 |

*Primary Examiner*—Patrick Ryan
*Assistant Examiner*—I.-H. Lin
*Attorney, Agent, or Firm*—Marshall, O'Toole, Gerstein, Murray & Borun

[57] ABSTRACT

A cope for a core box has a passage for passing sand into a core box cavity and a bore for passing catalyst into the core box cavity to harden a sand core formed therein. The bore may extend from an exterior surface of the cope to the cope passage. The cope may have structure for forming a seal with a sand injection tube following sand injection, such as a blow-up seal or an O-ring. A method of producing cores in a core box includes the step of providing a cope, a drag, and a cavity formed therebetween, the cope having a passage for receiving an injection tube and a bore for passing catalyst. Further steps include using the injection tube to inject sand through the cope passage into the cavity and passing catalyst through the bore in the cope into the cavity. A seal may be formed between the cope and the injection tube after sand injection.

16 Claims, 4 Drawing Sheets

COPE WITH BORE FOR GASSING CORES

TECHNICAL FIELD

The present invention is directed to apparatus and methods for the production of sand cores and, more particularly, to apparatus and methods for gassing sand cores.

BACKGROUND ART

Sand cores are typically produced in core boxes comprising a cope or top portion, a drag or lower portion and one or more cavities formed therebetween. An injection tube or extruding tube is inserted into a passage in the cope to inject core sand into the cavity. In the cold box method of forming sand cores, the core sand is mixed with resin and the cores are hardened by introducing catalyst into the core box.

In conventional cold box core making machines, catalyst is introduced into the core box after sand injection by removing the injection tube from the core box, transferring the core box by a transfer mechanism to a second location where the gassing plate is located, and placing the gassing plate onto the cope. The gassing plate extends into the passage in the cope when in the gassing position and passes catalyst into the cavity to harden the core or cores therein. Alternatively, the catalyst injection apparatus, such as the gassing plate, may be transferred to the core box prior to the placing of gassing plate onto the cope.

Conventional apparatus for gassing of cores has a number of disadvantages. The step of removing the injection tube from the core box to clear the cope passage for the gassing plate is time consuming. A further disadvantage is the necessity of transferring the core box or catalyst injection apparatus prior to introducing catalyst into the core box. Depending upon the size and complexity of the machine and core box, the cost of the transfer mechanism could account for several thousand dollars. Further, the machine cycle time is increased by 3 to 10 seconds for the transfer motion. Also time consuming is the step of placing the gassing plate upon the cope and pressing the gassing plate against the cope prior to gassing. The steps of removing the injection tube from the core box, transferring either the core box or the catalyst injection apparatus, and placing a gassing plate upon the cope are particularly time consuming because those steps are performed during each production cycle. Moreover, the gassing plates are an added expense.

SUMMARY OF THE INVENTION

The above disadvantages of the prior art devices are overcome by the present invention. More specifically, apparatus for forming sand cores in a core box includes a cope having a passage for the injection of sand into the core box and a bore for passing catalyst into a cavity in the core box. The bore may extend from an exterior surface of the cope, such as an exterior surface at the side of the cope, to the cope passage. The bore may be substantially horizontal.

In another embodiment, a core box includes a cope, a drag wherein a cavity is defined between the cope and the drag. The cope has a passage for the injection of sand into the cavity and a bore for passing catalyst to the cavity. The bore may extend from an exterior surface of the cope to the cope passage. In particular, the bore may extend from an exterior surface at the side of the cope to the cope passage and may be substantially horizontal.

In addition to the features of the embodiments described above, an injection tube may be provided for injecting sand into the cavity. Embodiments comprising an injection tube have a seal in contact with the injection tube and the walls defining the cope passage while the bore passes catalyst into the cavity. The cope may include an O-ring for forming a seal with the injection tube. Alternatively, the cope may include a blow-up seal for forming a seal with the injection tube.

None of the embodiments described above requires a gassing plate to gas the sand cores. Rather, as already mentioned, gas is supplied through the bore in the cope.

A further aspect of the invention is a method of producing cores in a core box. The method includes the step of providing a cope and a drag wherein a cavity is formed therebetween, the cope having a passage for receiving an injection tube and a bore for passing catalyst. Further steps include using the injection tube to inject sand through the passage into the cavity and passing catalyst through the bore in the cope into the cavity. The method may further include the step of forming a seal between the injection tube and a portion of the cope defining the cope passage after injecting sand and prior to passing catalyst into the cavity. Also included may be the step of moving the injection tube away from the cavity after injecting sand and prior to forming the seal between the injection tube and the portion of the cope defining the cope passage.

DESCRIPTION OF THE PREFERRED EMBODIMENTS

Figure 1:
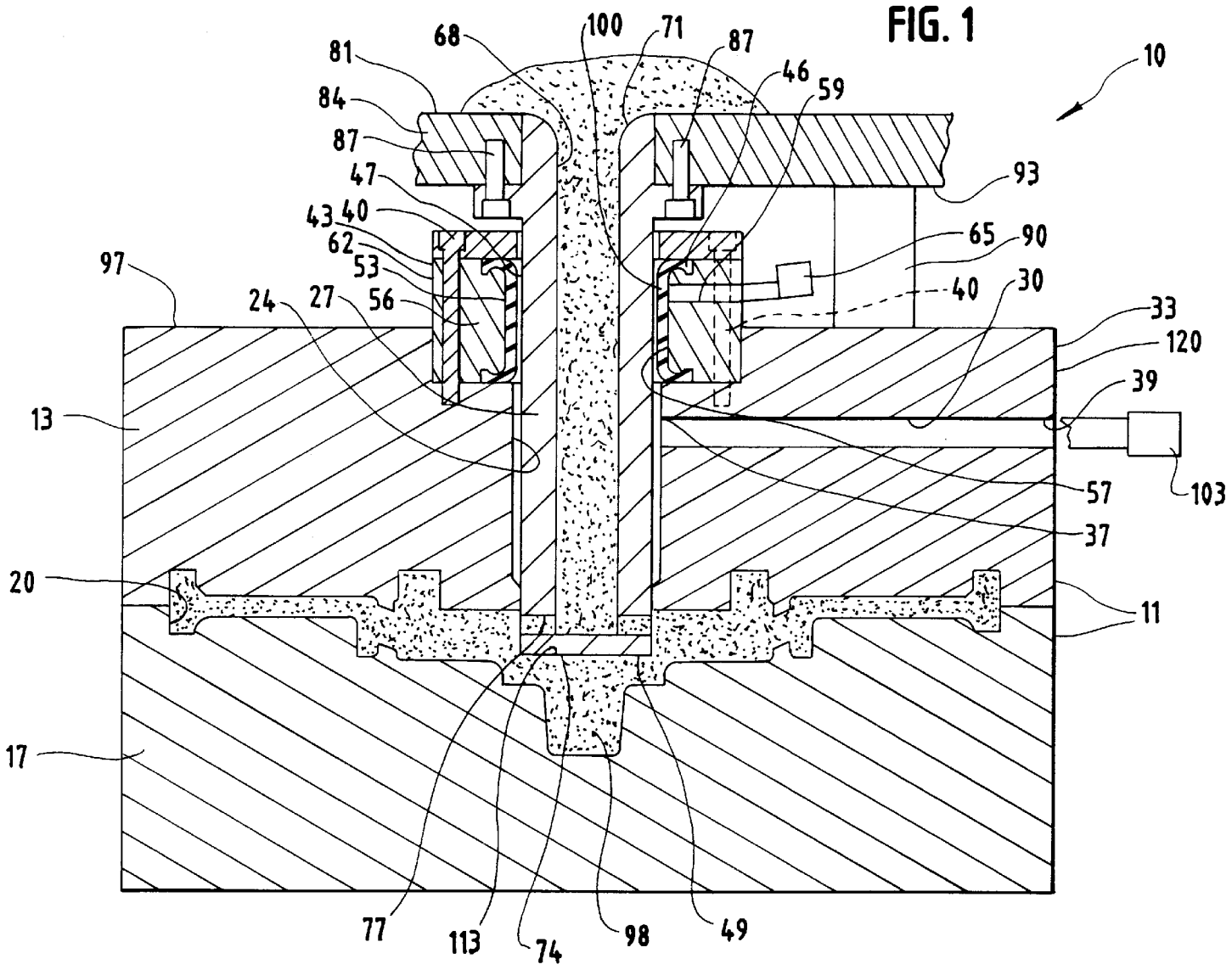
FIG. 1 comprises a sectional view of a core box incorporating the present invention shown with an injection tube in a sand injection position.
Figure 2:
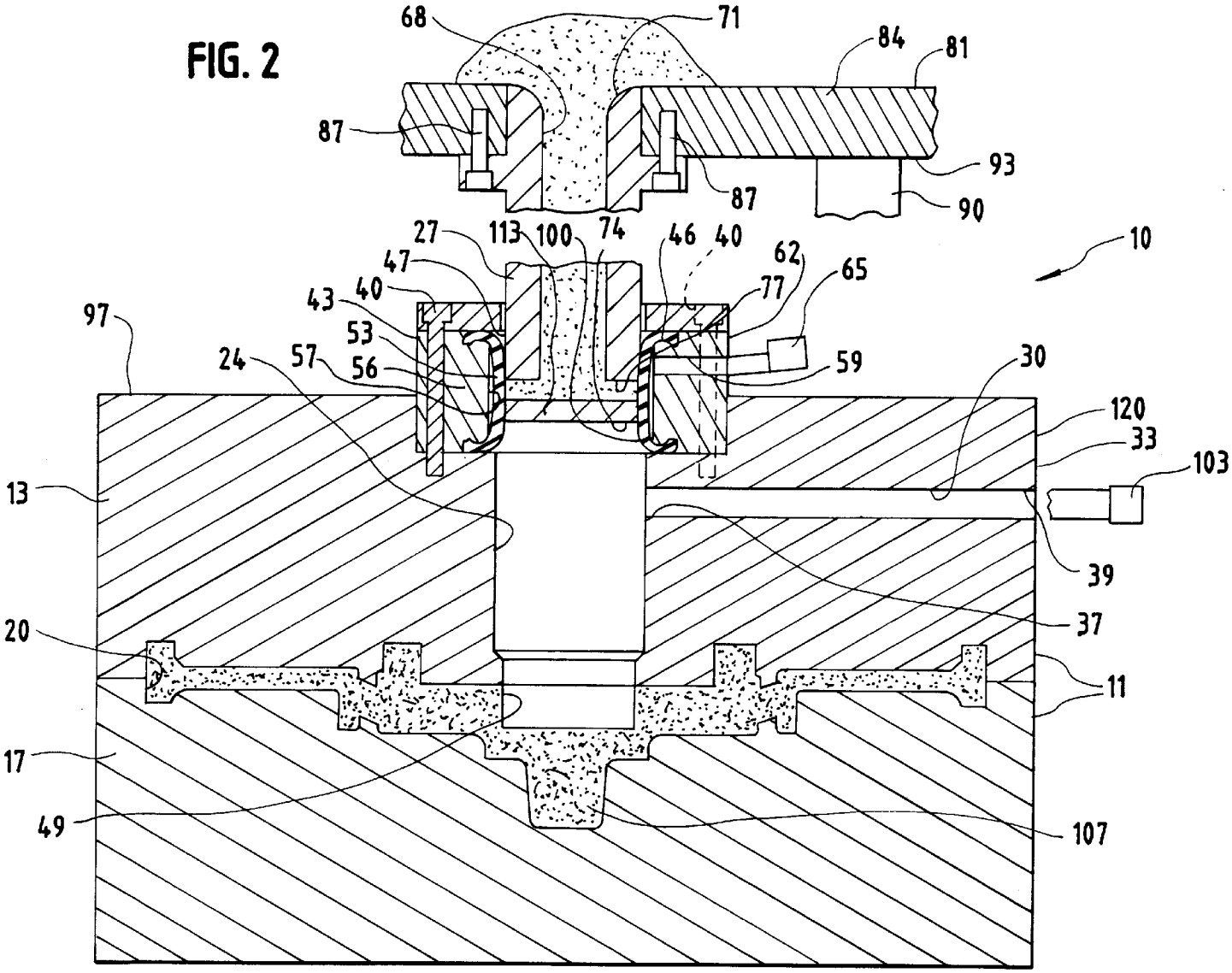
FIG. 2 comprises a sectional view similar to FIG. 1 of the core box shown with the injection tube in a raised position during introduction of catalyst.

Apparatus for forming sand cores is shown in FIGS. 1 and 2 and is designated generally at 10. The core forming apparatus 10 includes a core box 11 comprising a cope 13 disposed atop a drag 17 and one or more cavities 20 formed therebetween. The cope 13 has a passage 24 for receiving an injection tube 27 and a bore 30 extending from an exterior surface 33 of the cope 13 to the injection tube-receiving passage 24 at a passage inlet 37. A bore inlet 39 is defined by the cope 13 adjacent the exterior surface 33 and is in fluid communication with the bore 30.

Attached to the cope 13 by any suitable means such as bolts 40 is a blow-up seal assembly 43 comprising a flexible seal band 46, typically composed of rubber, located immediately adjacent the passage 24. In embodiments in which the passage 24 is vertical, such as shown in FIGS. 1 and 2, the assembly 43 is located above the passage inlet 37. The seal band 46 is located on one side of the passage inlet 37. The seal band 46 is anchored within a bore 47 extending through a block 56 such that an exterior surface 53 of the seal band 46 abuts a block surface 57. A seal assembly passage 59 extends from an exterior surface 62 of the block 56 to the exterior surface 53 of the flexible layer 46. A source 65 of air or other gas, shown schematically in FIGS. 1 and 2, is placed in fluid communication with the seal assembly passage 59.

As shown in FIGS. 1 and 2, the injection tube 27 may be of conventional construction and includes a passage 68 for passing sand into the cavity 20, a top portion 71, a bottom end 74, and at least one outlet 77 located between the top portion 71 and the bottom end 74. A blowplate 81 of a blowhead 84 or extruding head is connected to the top portion 71 of the injection tube 27 by any suitable means such as bolts 87. A spacer block 90 is connected to a bottom surface 93 of the blowplate 81 for determining the depth of insertion of the injection tube 27 into the core box 11.

In operation, the sand injection tube 27 is lowered into the passage 24 in the cope 13. As seen in FIG. 1, when the spacer block 90 contacts a top surface 97 of the cope 13, downward movement of the injection tube 27 relative to the cope 13 ceases and, in that position, the outlet 77 of the injection tube 27 is in communication with the cavity 20. The blowhead 84 or extruding head then injects core sand through the injection tube 27 and into the cavity 20 producing a soft or uncured core or cores 98 (FIG. 1).

Referring to FIG. 2, following sand injection the injection tube 27 is raised relative to the cope 13 until the bottom end 74 of the injection tube 27 is above the passage inlet 37 in the cope 13 and until the injection tube outlet 77 is adjacent the seal band 46. Air or other gas from the source 65 is passed through the seal assembly passage 59, exerting pressure on the exterior surface 53 of the seal band 46 and thereby causing the seal band 46 to deflect inwardly. While bending inwardly, an interior surface 100 of the seal band 46 abuts portions of the injection tube 27 adjacent the outlet 77, thereby sealing the outlet 77.

After the outlet 77 has been sealed, core curing is undertaken by operating a catalyst source 103 to inject catalyst through the bore 30 in the cope 13 to the passage 24. The catalyst passes into the cavity 20 and, because the outlet 77 of the injection tube 27 is sealed by the seal band 46, the catalyst does not enter the injection tube 27 or escape through the cope 13 between the injection tube 27 and the cope 13.

Following hardening, the flow of catalyst is stopped and air or another gas is introduced through the bore 30 into the core box 11 to purge the core box 11 of catalyst. Ejection of hardened cores 107 (FIG. 2) may be performed in a conventional manner. For example, the drag 17 may be lowered relative to the cope 13 by a ram (not shown) and the hardened cores 107 may then be ejected by ejector pins (not shown). Alternatively, the lowered drag 17 may be shuttled to an ejector (not shown) for core ejection.

Figure 3:
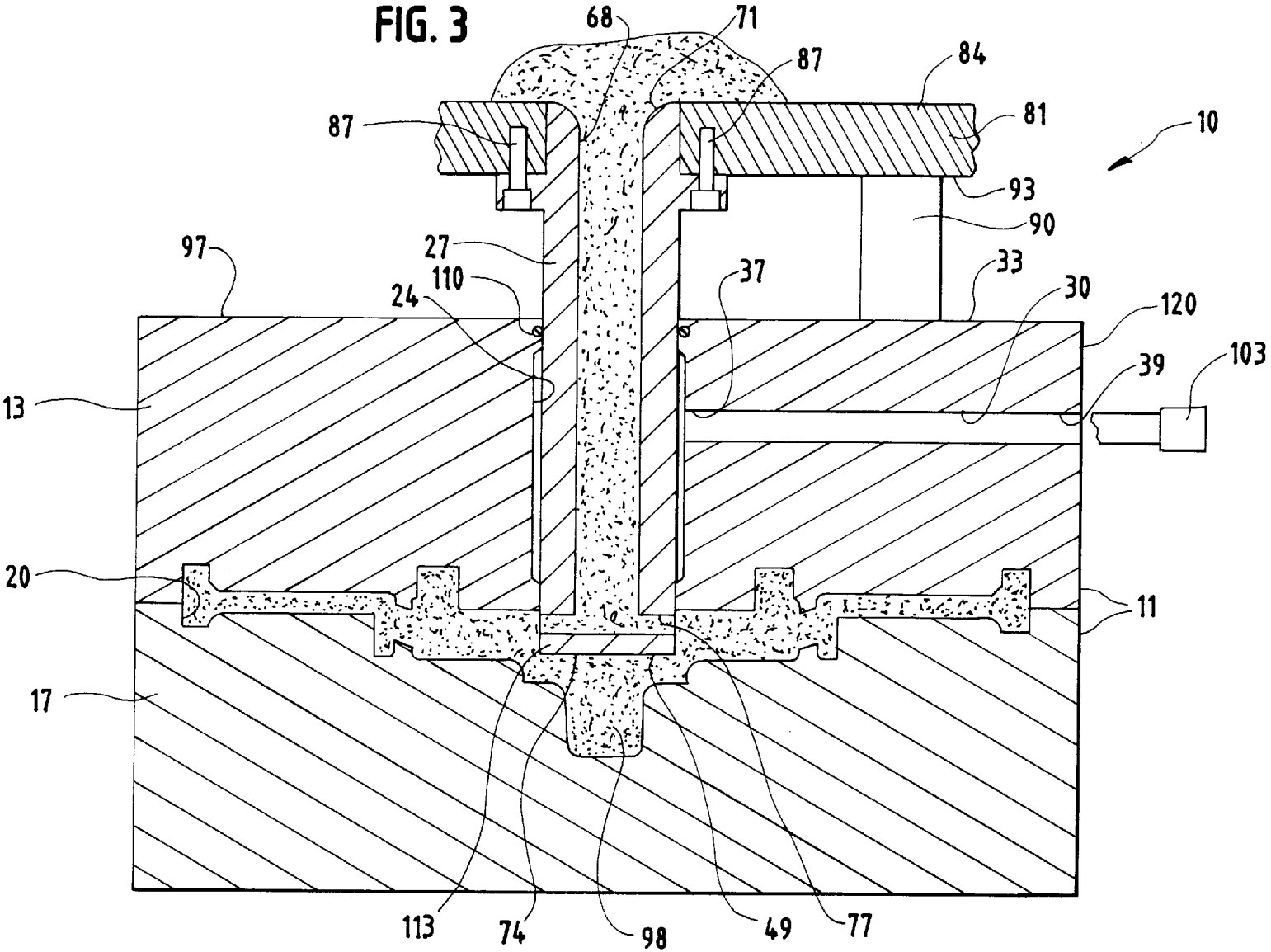
FIG. 3 comprises a sectional view similar to FIG. 1 of an alternative embodiment of the present invention shown with an injection tube in a sand injection position.
Figure 4:
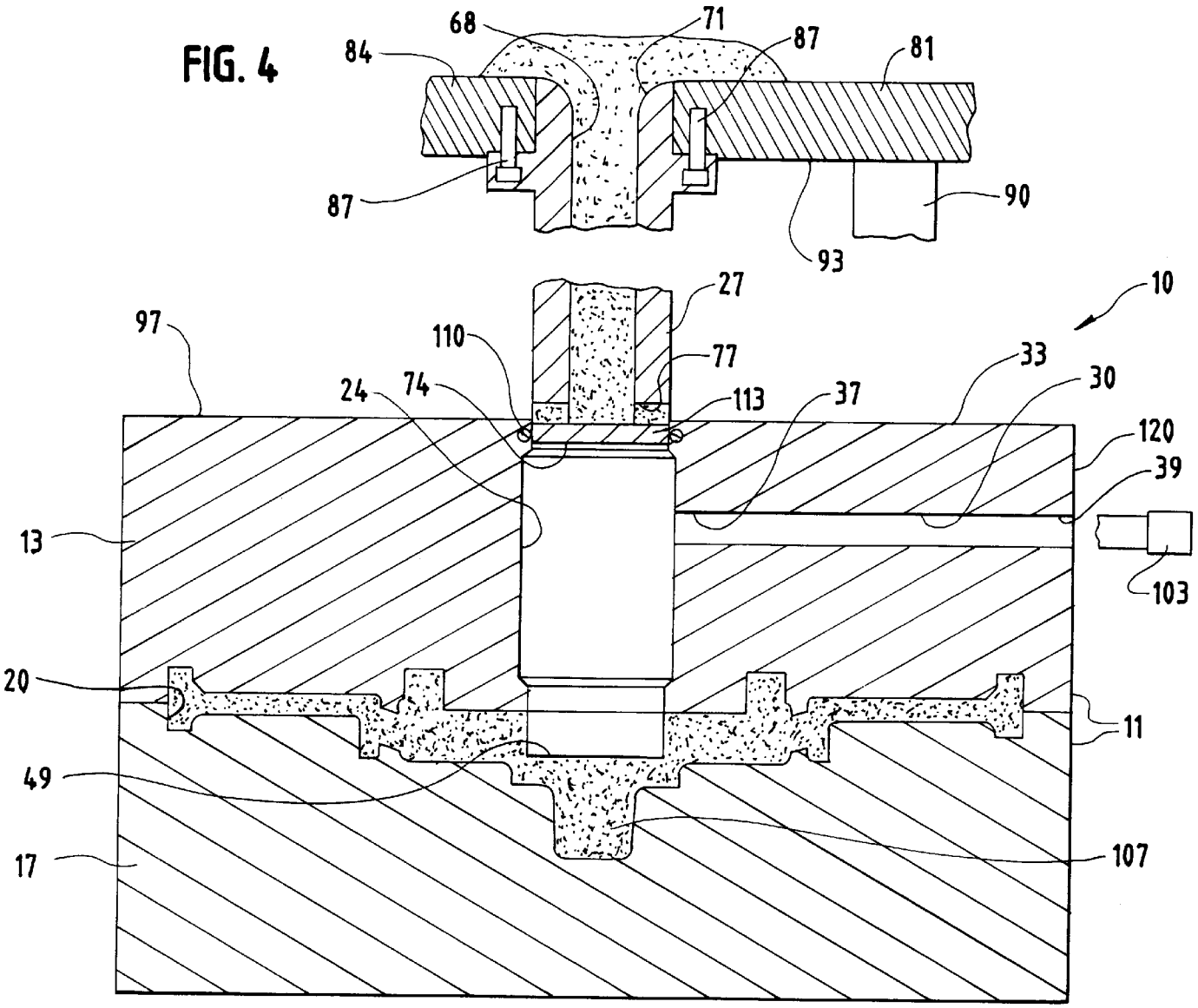
FIG. 4 comprises a sectional view similar to FIG. 2 of the embodiment of FIG. 3.

As shown in FIGS. 3 and 4, the cope 13 may have an O-ring 110 for seating the passage 24 during catalyst injection rather than the blow-up seal assembly 43 shown in FIGS. 1 and 2. In this embodiment, the O-ring 110 is disposed in the cope 13 around the passage 24 and, in the embodiment of FIGS. 3 and 4 wherein the cope 13 has a vertical passage 24, the O-ring 110 is located above the passage inlet 37. More generally, the O-ring 110 is located on a side of the passage inlet 37 opposite the cavity 20. A conventional sand injection tube 27 such as that illustrated in FIGS. 3 and 4 may be used in conjunction with the O-ring 110.

Sand injection proceeds for the embodiment shown in FIGS. 3 and 4 in the same fashion as described above in connection with the embodiment of FIGS. 1 and 2. Catalyst injection proceeds similarly to the catalyst injection sequence for the embodiment shown in FIGS. 1 and 2 except that instead of the seal band 46 of the blow-up seal assembly 43 forming a seal at the injection tube outlet 77 (as seen in FIG. 2), the O-ring 110 forms a seal with a bottom portion 113 of the injection tube 27 (as seen in FIG. 4). The bottom portion 113 of the injection tube 27 is located below the outlet 77 of the injection tube 27.

Although the seal formed between the injection tube 27 and the cope 13 during catalyst injection has been described as either the blow-up seal assembly 43 or the O-ring 110, any seal between the injection tube 27 and the cope 13 will facilitate the hardening of cores by catalyst injection so long as the passage 24 is isolated from the passage 68 during catalyst injection. Although shown disposed horizontally, the bore 30 may instead be oriented in any other direction. Thus, for example, the bore 30 may extend from the top surface 97 of the cope 13 to the passage 24 or may extend from a location at an exterior side 120 of the cope 13 that has a different height relative to the passage inlet 37 height.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

We claim:

1. An apparatus for forming sand cores in a core box having a horizontal parting line, the apparatus comprising:

a cope having a passage for the injection of sand into the core box and a bore for passing catalyst into a cavity in the core box; and a drag, wherein the cope is disposed atop the drag.

2. The apparatus of claim 1, wherein the bore extends from an exterior surface of the cope to the cope passage.

3. The apparatus of claim 2, wherein the bore extends from an exterior surface at the side of the cope and is substantially horizontal.

4. A horizontal parting line core box comprising:

a cope; and a drag wherein the cope is disposed atop the drag and a cavity is defined between the cope and drag;

the cope having a passage for the injection of sand into the cavity and a bore for passing catalyst to the cavity.

5. The core box of claim 4, wherein the bore extends from an exterior surface of the cope to the cope passage.

6. The core box of claim 5, wherein the bore extends from an exterior surface at the side of the cope to the cope passage.

7. The core box of claim 6, wherein the bore is substantially horizontal.

8. Apparatus for producing cores, comprising:

a cope;

a drag wherein a cavity is defined between the cope and the drag;

an injection tube for injecting core sand;

the cope having walls defining a passage for receiving the injection tube and a bore for passing catalyst into the cavity; and a seal in contact with the injection tube and the walls defining the cope passage while the bore passes catalyst into the cavity.

9. The apparatus of claim 8, wherein the apparatus does not have a gassing plate.

10. The apparatus of claim 8, wherein the cope comprises an O-ring for forming a seal with the injection tube.

11. The apparatus of claim 8, wherein the cope comprises a blow-up seal for forming a seal with the injection tube.

12. Apparatus for producing cores, comprising:

a cope;

a drag wherein the cope is disposed atop the drag and a cavity is defined between the cope and the drag;

an injection tube for injecting core sand;

the cope having walls defining a passage for receiving the injection tube and a bore for passing catalyst into the cavity; and a seal in contact with the injection tube and the walls defining the cope passage while the bore passes catalyst into the cavity.

13. A method of producing cores in a core box, the method comprising the steps of:

providing a cope, a drag, and a cavity formed therebetween, the cope having a passage for receiving an injection tube and a bore for passing catalyst;

positioning the cope atop the drag;

injecting sand through the injection tube and through the cope passage into the cavity; and passing catalyst through the bore in the cope into the cavity.

14. A method of producing cores in a core box, the method comprising the steps of:

providing a cope, a drag, and a cavity formed therebetween, the cope having a passage for receiving an injection tube and a bore for passing catalyst;

injecting sand through the injection tube and through the cope passage into the cavity;

forming a seal between the injection tube and a portion of the cope defining the cope passage after injecting sand and prior to passing catalyst into the cavity; and passing catalyst through the bore in the cope into the cavity.

15. The method of claim 14, further comprising the step of moving the injection tube away from the cavity after injecting sand and prior to forming the seal between the injection tube and the portion of the cope defining the cope passage.

16. A method of producing cores in a core box, the method comprising the steps of:

providing a cope, a drag, and a cavity formed therebetween, the cope having a passage for receiving an injection tube and a bore for passing catalyst;

positioning the cope atop the drag;

injecting sand through the injection tube and through the cope passage into the cavity;

forming a seal between the injection tube and a portion of the cope defining the cope passage after injecting sand and prior to passing catalyst into the cavity; and passing catalyst through the bore in the cope into the cavity.

* * * * *